United States Patent [19]

Hamano

[11] Patent Number: 4,515,366

[45] Date of Patent: May 7, 1985

[54] SLOT MACHINE WITH PATTERN CONFIRMATION AND CORRECTION MEANS

[76] Inventor: Junichi Hamano, 24-13, Koshienkitamachi, Nishinomiya-Shi, Hyogo 633, Japan

[21] Appl. No.: 478,186

[22] Filed: Mar. 23, 1983

[30] Foreign Application Priority Data

Aug. 12, 1982 [JP] Japan ..... 57-140722

[51] Int. Cl.[3] ..... A63F 5/04

[52] U.S. Cl. ..... 273/143 R; 273/138 A

[58] Field of Search ..... 273/143 R, 138 A, 143 A–143 E; 235/1 R, 1 B, 1 C

[56] References Cited

U.S. PATENT DOCUMENTS

| | | | |
|---|---|---|---|
| 4,095,795 | 6/1978 | Saxton et al. | 273/143 R |
| 4,238,127 | 12/1980 | Lucero et al. | 273/143 R |
| 4,239,225 | 12/1980 | Burnside | 273/143 R |
| 4,299,388 | 11/1981 | Resch et al. | 273/138 A |

FOREIGN PATENT DOCUMENTS

| | | | |
|---|---|---|---|
| 1550732 | 8/1979 | United Kingdom | 273/143 R |

*Primary Examiner*—Richard C. Pinkham
*Assistant Examiner*—MaryAnn Stoll Lastova
*Attorney, Agent, or Firm*—Jordan and Hamburg

[57] ABSTRACT

A slot machine includes a plurality of rotary drums on the periphery of which plural frames of patterns are depicted. Detecting plates are connected to each rotary drum and the detecting plates are provided with pattern detecting elements whose number corresponds to the number of frames. Readers detect passage of the pattern detecting elements during drum rotation, and a control device counts the output of the readers and specifies the patterns positioned on a stop line based on the counted value after the drum stops. Each of the detecting plates provides for pattern confirmation which discriminates the pattern positioned on the stop line at least from the preceding and following frames of patterns when the drum is stopped, and the counted value is corrected in response to the pattern confirming device.

12 Claims, 9 Drawing Figures

(1)

| | C | M | D |
|---|---|---|---|
| Address NO. 0 | 0000 | 0001 | |
| Address NO. 1 | 1000 | 0100 | |
| Address NO. 2 | 0000 | 0101 | |
| Address NO. 3 | 1000 | 0100 | |
| Address NO. 4 | 0000 | 0110 | |
| ⋮ | 1000 | 0101 | |
| | 0000 | 0101 | |
| Address NO. 19 | 1000 | 0100 | |
| Address NO. 20 | 0000 | 0101 | |

(2)

| | |
|---|---|
| Counter output | m1 |
| Pattern data | m2 |
| $F_1$ | m3 |
| $F_2$ | m4 |

SLOT MACHINE WITH PATTERN CONFIRMATION AND CORRECTION MEANS

The present invention relates to a slot machine which decides gain or loss of a game by means of agreement or disagreement of patterns with each other by detecting the patterns of respective rotary drums standing side by side on a stop line when a plural number of rotary drums are stopped. More particularly the present invention relates to a slot machine which provides a means of correcting a pattern detection miss caused by the phenomenon that a rotary drum moves finely forward and backward (hereinafter referred to as chattering) when a stopping mechanism of the rotary drum is operated.

In the conventional slot machines, a metal detecting plate for detecting the drum stop position, that is, the pattern positioned on the stop line, is connected to each rotary drum. On this detecting plate, as shown in FIG. 8, detecting holes 71 whose number agrees with the number of frames of patterns are installed at equal intervals, and the detecting holes 71 passing through an optical reader installed on a predetermined position are counted by a counter, and the pattern of the frame stopped on the stop line is specified in response to the counted number when the rotary drum is stopped.

In this kind of slot machine, concave grooves 73 whose number agrees with the number of frames of patterns are installed on the periphery of a detecting plate 72, and when an engaging piece 74 of a stop mechanism is engaged into any one of the concave grooves 73, the rotary drum is stopped forcedly, and a given frame is positioned on the stop line. However, sometimes this engaging piece 74 collides with the slanting surface of a peaked portion 75 between the concave grooves 73 and 73 and stops rotation of the detecting plate 72, and thereafter falls into the concave groove 73 while reversely rotating the detecting plate 72 by a very small angle. By this chattering at a drum stop, the detecting hole 71 immediately after passing an optical reader resultantly traverses the reader again in the reverse direction, and consequently 1 is added excessively to the counted number of the counter.

Thus, the pattern on the stop line specified based on the counted value disagrees with the pattern currently positioned on the stop line, and due to this pattern detection miss, erroneous operations of machine such as an erroneous judgement of the game and the like are incurred.

The present ivention provides a novel slot machine which realizes an error-free machine operation in such a manner that a check is made if the above-mentioned counted value is varied by chattering, and when a variation is found, this is corrected to an appropriate value and thereby a pattern detection miss is prevented.

In order to attain the above-mentioned objective, in the present invention, a configuration is made in such a manner that a pattern confirming means which discriminates the pattern positioned on the stop line at a drum stop at least from the preceding and following frames is installed on the above-mentioned detecting plate corresponding to the specific frame, and also when its result of confirmation conflicts with the pattern specified from the above-mentioned counted value, the counted value is subtracted by 1, or the like, and thereby a correction is made to an appropriate value.

By applying the present invention, even when a pattern detection miss takes place due to chattering, the pattern detection miss can be easily corrected by checking against the result of confirmation by the pattern confirming means, and thereby no erroneous judgement of the game takes place and an accurate machine operation can be realized. As mentioned above, an excellent effect attaining the purpose of the present invention is demonstrated.

Hereinafter, the present invention is described with reference to an embodiment as shown in the drawings.

DESCRIPTION OF THE PREFERRED EMBODIMENTS

Figure 1:
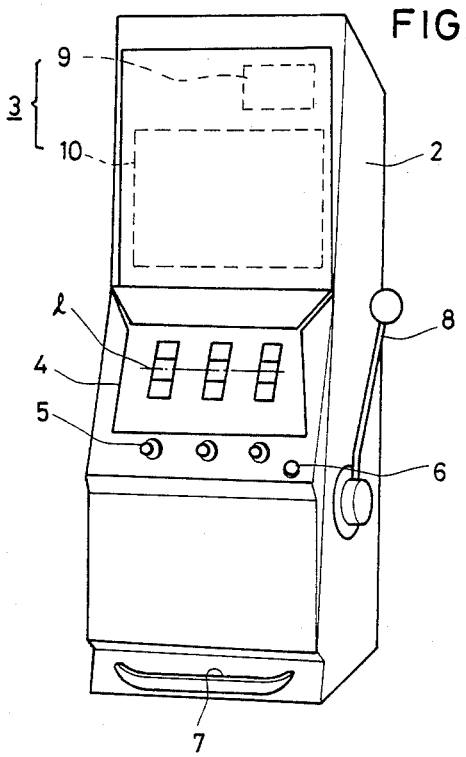
FIG. 1 is a perspective view of a slot machine according to one embodiment of the invention.

FIG. 1 shows a slot machine having three rotary drums 1*a*, 1*b* and 1*c*, a guide display part 3 disposed on the upper part of the front face of a body 2, a pattern display part 4, three stop push-button switches 5 and a medal receiving slot 6 disposed on the center part. A medal discharging outlet 7 is disposed on the lower part, and an operation handle 8 is mounted on the side face of the body 2 so that a foward-tilting motion can be made.

The guide display part 3 comprises a numeric display part 9 and a blinking display part 10, and the number of medals to be paid out is displayed digitally on the numeric display part 9, while information relating to the game contents such as the number of medals deposited in, the multiplying factor of pay out, and the like are displayed by the blinking of lamps.

The pattern display part 4 is a part which displays patterns of respective rotary drums 1*a*, 1*b* and 1*c* by aligning them side by side along one or more stop lines (only one line is shown in the drawings), and is so constituted that only three frames of patterns on the peripheral face of each drum can be seen from the outside of the body when the three rotary drums 1*a*, 1*b* and 1*c* are disposed in parallel in the body 2 stop position.

Figure 2:
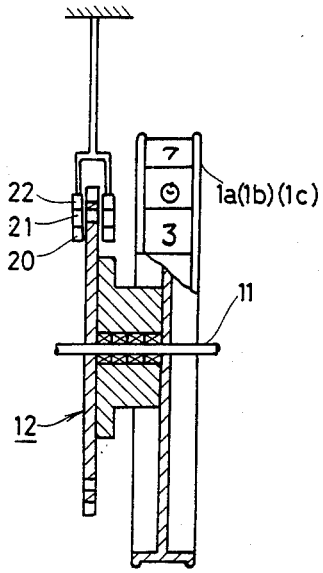
FIG. 2 is a front view, partially broken away and in section, of a rotary drum.
Figure 3:
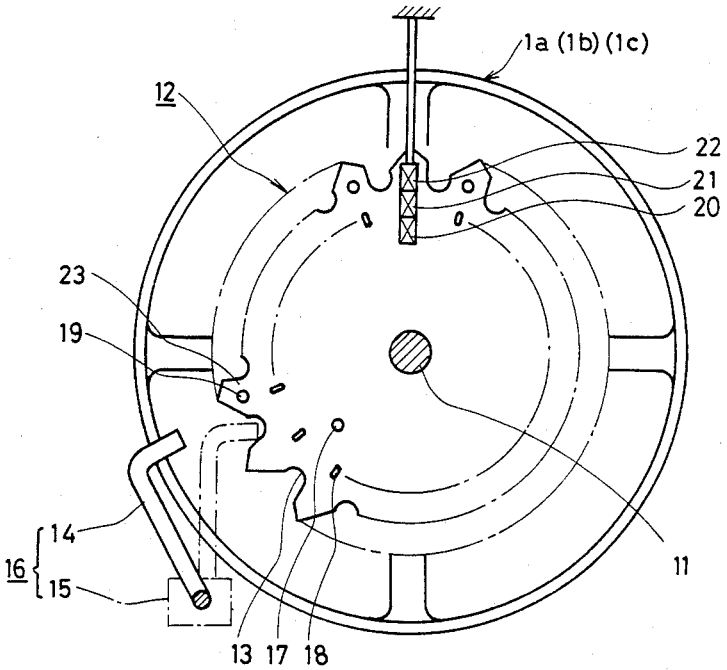
FIG. 3 is a side view of a detecting plate.

The above-mentioned first—third drums 1*a*, 1*b* and 1*c* are, as shown in FIG. 2, disposed on a rotary shaft 11 in a freely rotatable manner respectively, and the rotary drum is started up by kicking a metal detecting plate 12 fixed to the side face of each drum with a start lever (not illustrated). Rotation of the drum is maintained by means of dynamic friction between the rotary shaft 11 and the rotary drum with the rotary shaft 11 being rotated by a motor drive. On the peripheral edge of the above-mentioned detecting plate 12, as shown in FIG. 3, plural concave grooves 13 whose number agrees with the number of frames of patterns (a total of 21 frames in the present embodiment) are installed, and a stopping mechanism 16 includes an engaging piece 14 which stops rotation of the drum by engaging one of the concave grooves 13. A solenoid 15 engages and releases the engaging piece 14 into and from the detecting plate 12.

The stopping mechanism 16 of each rotary drum is such that the rotary drum is stopped by the customer's pushing the stop push-button switch 5, however, otherwise the arrangement can be applied that respective rotary drums are stopped by automatically operating the stopping mechanisms in sequence after set times have elapsed.

On the above-mentioned detecting plate 12, there are three kinds of holes; a reference hole 17, pattern detecting holes 18, and pattern confirming holes 19. Optical readers 20, 21 and 22 composed of a light projector and a light receiver are disposed at the positions corresponding to each row of holes. There is only one reference hole 17 and the number of pattern detecting holes 18 correspond to the number of frames of patterns in each rotary drum at equal intervals, and every time each hole traverses the light paths of the readers 20, 21 and 22, the reader 20 outputs reference pulses, and the reader 21 outputs count pulses, respectively. These count pulses are counted by a counter (not illustrated) of a control part 29 as described later, and the contents of the counter are cleared by the reference pulse. Thus the control part 29 specifies the drum stop position, in other words, the pattern positioned on the stop line, based on the counted value of the counter when the drum stops. Furthermore, the above-mentioned pattern confirming holes 19 are installed to discriminate the pattern of the frame positioned on the stop line from the patterns of the preceding and the following frames, and in the present embodiment these are installed alternately at center portions of peaked parts 23 on the detecting plate 12.

Accordingly, in the present embodiment, a total of ten confirming holes 19 are installed for the 21 peaked portions 23, and no confirming hole is installed at any of a first and a second peaked portions 23, and the above-mentioned reference hole 17 performs the function of the confirming hole. Furthermore, the above-mentioned detecting plate 12 can be constituted by affixing reflecting sheets in place of each hole, and magnetic readers can be adopted in place of the optical readers. Furthermore, for the above-mentioned pattern confirming holes 19, other systems can be adopted, for instance, one or more holes constituting each bit may be installed at the peaked portions 23 and other positions to pick up a binary signal, and the like, not limited to the system in the present illustrated embodiment.

Figure 4:
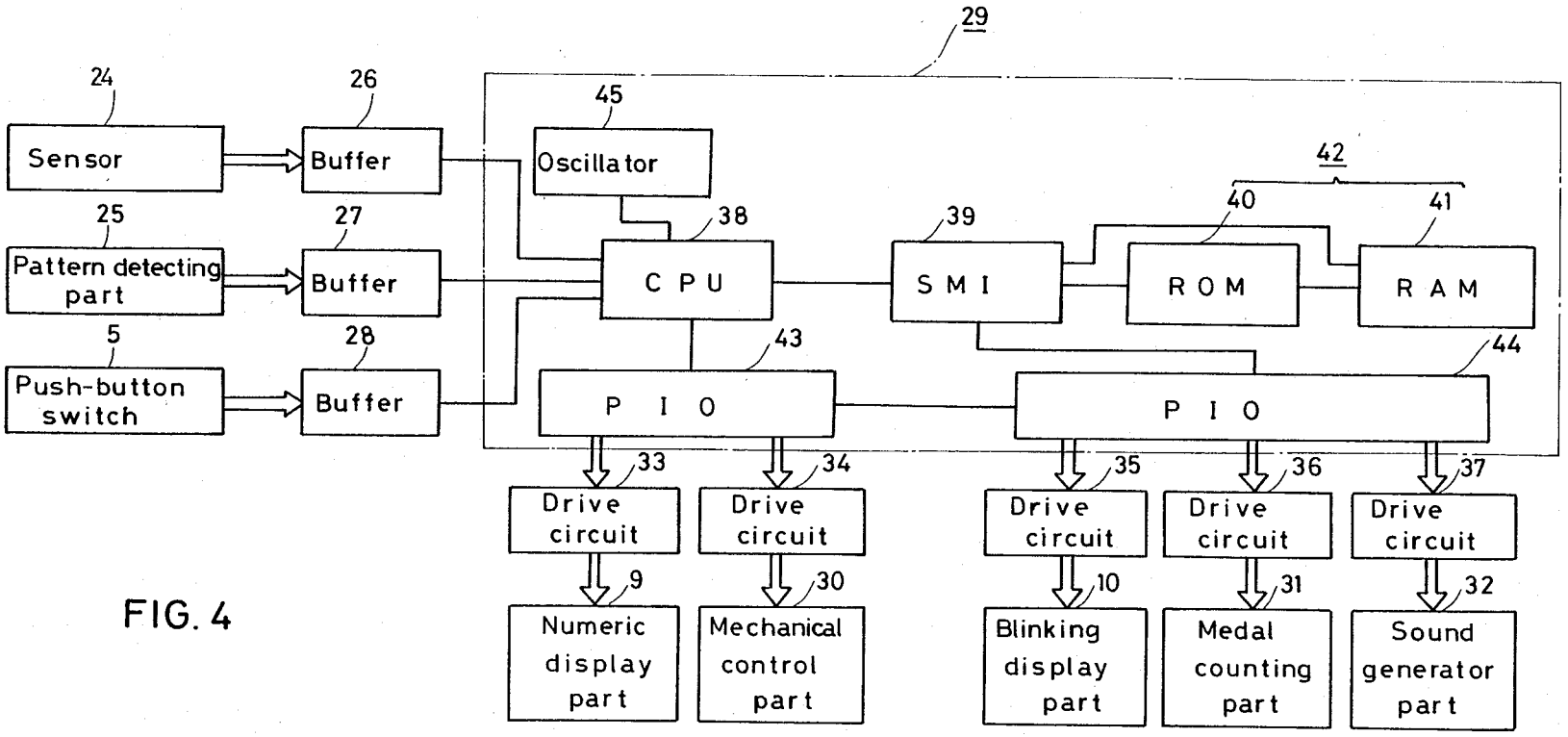
FIG. 4 is a block diagram showing a circuit configuration of the slot machine.

FIG. 4 shows an example of circuit configuration of a slot machine, and in the figure, a sensor 24 detects whether medals are inserted in the machine, and a pattern detecting part 25 comprises the above-mentioned detecting plate 12 and readers 20, 21 and 22, and detects the pattern of each drum positioned on the stop line of the pattern display part 4. The customer stops rotation of the first—the third drums 1*a*, 1*b* and 1*c* by pushing the push-button switch 5. Respective outputs of these input parts are stored once in buffers 26, 27 and 28, and thereafter sent to the control part 29. Also, the numeric display part 9 in the illustration displays digitally the number of medals to be paid out, and a mechanism control part 30 controls operations of a motor for rotating the drums, the solenoid 15 of the stopping mechanism 16, and the like. Furthermore, the blinking display part 10 displays various information by means of blinking lamps, and a medal count part 31 counts the numbers of medals deposited and medals paid out, and a sound generator part 32 generates game effective sounds, alarm sounds and the like. These output parts are operated by drive circuits 33, 34, 35, 36 and 37 respectively, and each drive circuit is drive-controlled by the control circuit 29.

The control part 29 is constituted with a microcomputer and comprises an arithmetic processor 38 (hereinafter simply referred to as CPU), a memory 42 composed of a ROM 40 (Read Only Memory) and a RAM 41 (Random Access Memory) which are connected to the CPU 38 through a static memory interface 39 and I/O parts 43 and 44 which are installed between the CPU 38 and each output part, and furthermore an oscillator 45 for generating clock pulses is connected to the CPU 38. Various programs and fixed data required for game proceeding are stored in the above-mentioned ROM 40 and various data are stored in the RAM 41 respectively, and the CPU 38 decodes and executes the programs as shown in FIGS. 6 and 7, reads required data out of the RAM 41 and performs various operations and processings, and also controls operations of Input/Output parts.

Figures 5, 8:
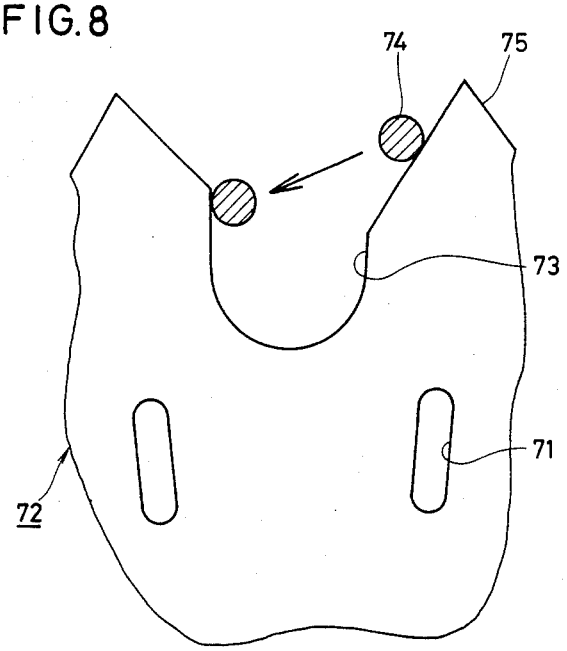
FIGS. 5(1) and 5(2) are explanatory diagrams of a memory configuration.
FIG. 8 is a partial side view, on a larger scale, of a detecting plate.

FIG. 5 (1) shows the memory contents of the ROM 40, and pattern data D on a frame basis are stored for one rotary drum in the addresses Nos. 0–20 of a memory area M, respectively. Each pattern data D is constituted with four bits and an indentification code C of the same four-bit configuration is added to the respective pattern data D. This identification code C corresponds to the above-mentioned pattern confirming hole 19, and the code "1000" is given to the pattern data D of the frames stored in the odd addresses other than the above.

FIG. 5 (2) shows the memory contents of the RAM 41, and the counted value of the counter at the drum stop is set in an area $m_1$, and pattern data D stored in the address of the above-mentioned area M equivalent to the counted value is set in an area $m_2$. Furthermore, a confirming flag $F_1$ for indicating whether or not the reader 22 has detected the confirming hole 19 is set in a flag area $m_3$ and an identification flag $F_2$ for indicating whether or not any of the identification codes C, "1000" and "0000" is added to the pattern data D set in the above-mentioned area $m_2$ is set in a flag area $m_4$.

Figure 6:
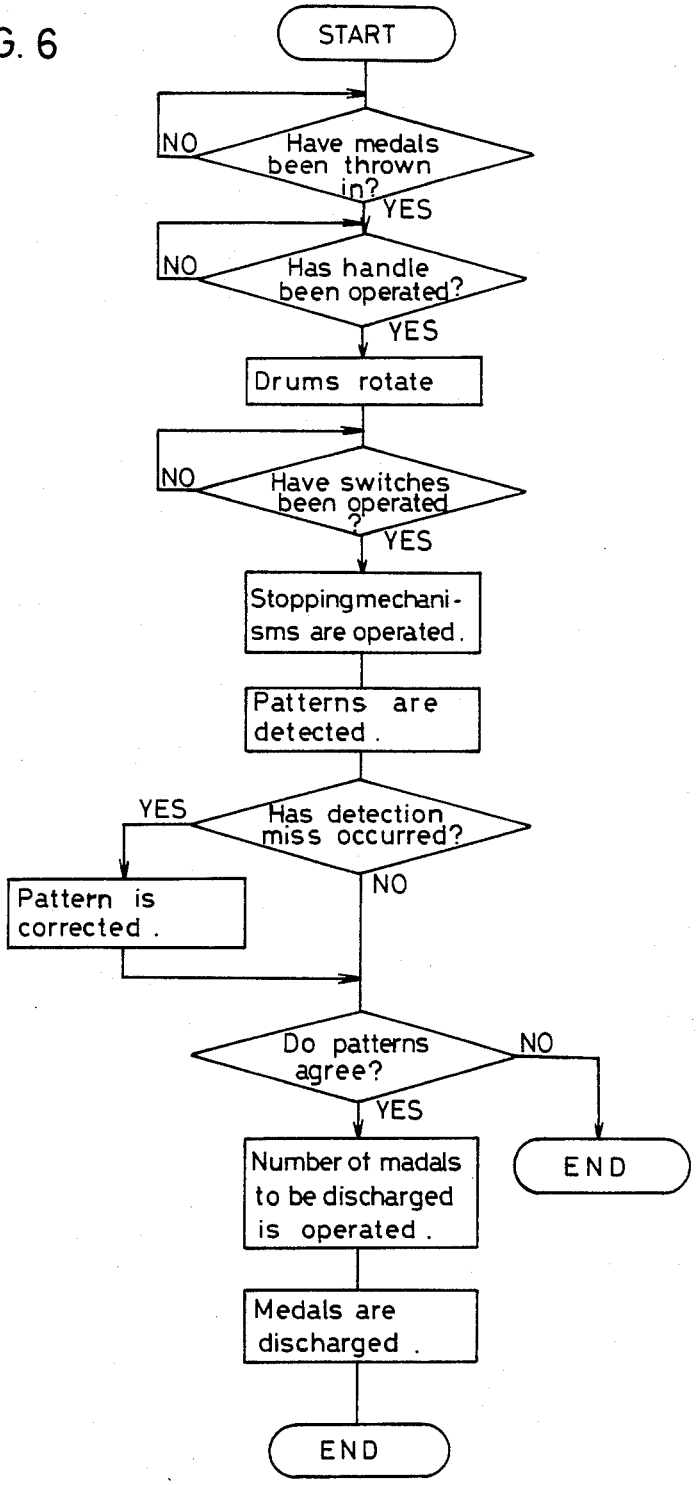
FIGS. 6 and 7 are flow charts showing the operation of the slot machine.
Figure 7:
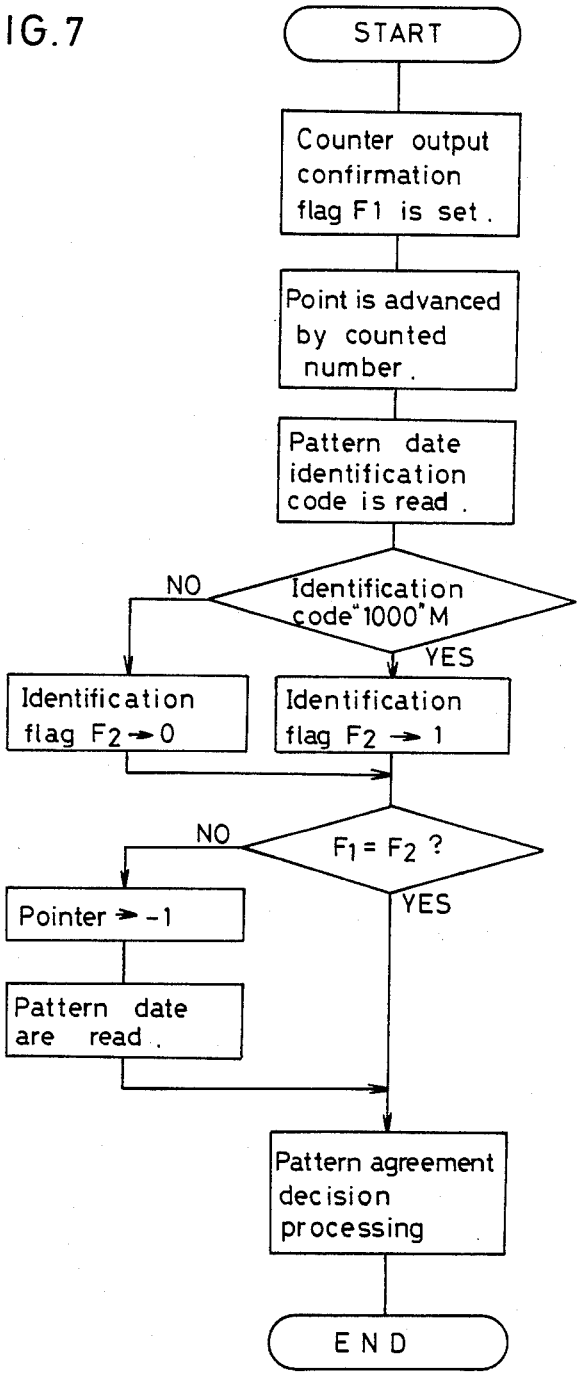

FIG. 6 shows an operational flow a slot machine, and when medals are inserted in the medal insert inlet 6, the decision "Have medals been inserted?" in Step 50 becomes "YES" and the lock of the operation handle 8 is released. Subsequently, after operation handle 8 is released. Subsequently, by operating the operation handle 8, the decision "Has the handle been operated?" in Step 51 becomes "YES", and all the rotary drums 1*a*, 1*b* and 1*c* are rotated together in Step 52. Subsequently, when the stop push-button switches 5 are pushed for each rotary drum, the decision "Have the switches been operated?" in Step 53 becomes "YES", and the stopping mechanisms 16 of each rotary drum are operated in Step 54, and the engaging piece 14 is engaged into any one of the grooves 13 on the detecting plate 12 and the rotary drum is stopped forcedly. Then, in the next Step 55, the identity of pattern of each rotary drum stopping on the stop line is detected. Furthermore, in the next Step 56, a check is made on whether or not any pattern detection miss is present by chattering at the drum stop, and when its decision is "NO", the processing proceeds to the next Step 57, while when the decision is "YES", a pattern correction processing is executed in Step 60, and thereafter the processing proceeds to Step 57. Thus in Step 57, a decision is made on whether patterns of each rotary drum positioned on the stop line agree with each other or whether they stand side by side in a certain arrangement, or the like, and if the decision is "YES", the game is "gained", and the number of medals to be discharged is operated in Step 58, and thereafter the predetermined number of medals are discharged to the medal discharge outlet 7 in Step 59. Also, if the decision in Step 57 is "NO", the game is "lost", and the subsequent game proceeds.

Details on the pattern detection and correcting operation in the above-mentioned Steps 55, 56 and 60 are shown in a control flow chart in FIG. 7.

When the rotary drum is rotating in the above-mentioned Step 52, the reader 21 outputs the count pulse every time the detecting hole 18 on the detecting plate 12 passes through, and this pulse is counted by, for instance, a counter contained in the CPU 38. This counter is cleared every time the reference pulse is inputted from the reader 20. Then, when the rotary drum is stopped, the counted value of the counter is data-stored in the area $m_1$ of the RAM 41. Also, when the confirming hole 19 is stopped at the position of the reader 22 at the drum stop, the confirmation flag $F_1$ of "1" is set in the flag area $m_2$, while when the confirming hole 19 is placed out of the position of the reader 22, the confirmation flag $F_1$ of "0" is set in the flag area $m_3$. In the next Step 62, the pointer is advanced by the number equivalent to the counted value of the above-mentioned counter, and the corresponding address is indicated among the area M of the ROM 40. Then, the pattern data D and the identification code C of the address are read in Step 63 and check is made on whether the identification code C is "1000" or "0000". When the identification code C is "1000", the decision in Step 64 becomes "YES", and the identification flag $F_2$ of "1" is set in flag area $m_4$ in Step 65. On the other hand, when the identification code C is "0000", the decision in Step 64 becomes "NO", and the identification Flag $F_2$ of "0" is set in flag area $m_4$ in Step 66.

Thus, when the reader 21 outputs two count pulses for the same detecting hole 18 due to chattering, and thereby the counter counts one exessive pulse, the above-mentioned confirmation flag $F_1$ and identification flag $F_2$ disagree, and the decision "$F_1=F_2$" in Step 67 becomes "NO". On the other hand, when the counted value of the counter is adequate, both the flags $F_1$ and $F_2$ agree with each other, and the decision in Step 67 becomes "YES". When Step 67 is "YES" for each rotary drum, the processing proceeds to the next Step 68 and the decision is made on agreement or disagreement of patterns of each frame. On the other hand, for the rotary drum where step 67 becomes "NO", the content of the pointer is subtracted by one, and the preceeding address is indicated in the area M of the ROM 40. Then, the pattern data D of that address is read out anew in Step 70, and the decision processing of pattern agreement in Step 68 is executed with this data.

I claim:

1. A slot machine comprising a plurality of rotary drums on the periphery of which plural frames of patterns are depicted, detecting plates connected to each rotary drum and provided with pattern detecting means whose number corresponds to the number of frames, said detecting plates having grooves, reader means which detect passing of said pattern detecting means during drum rotation, stopping means engaging said grooves in said detecting plates and operable to stop said detecting plates, said stopping means causing reverse rotation of said detecting plate and drum depending on the position of said groove when initially engaged by said stopping means, a control means which counts the output of said reader means and specifies the pattern positioned on a stop line based on the counted value after the drum stops, pattern confirming means on said detecting plates which discriminate the pattern positioned on the stop line at least from the preceding and following frames of patterns when the drum is stopped such that said pattern confirming means detects an increase of said counted value resulting from said reverse rotation of said drum and consequent passing of said pattern detecting means again past said reader means, and correction means providing for correcting said increased counted value in response to said pattern confirming means detecting said increased counted value.

2. A slot machine according to claim 1, wherein said detection plates each have generally radial projections with said grooves being disposed between each said projection, said stopping means having a stopper element adapted to be received in said groove to stop rotation of said drum, said pattern detecting means comprising a detection element for each of said projections, said pattern confirming means comprising a detection element for every other one of said projections.

3. A slot machine according to claim 1, wherein said stopping means has a stopping element adapted to engage said groove to stop rotation of the drum, said grooves in said detection plates each having an outer radial portion which is wider in a circumferential direction than the width of said stopping element, said outer radial portion of said groove having two groove walls which are engageable by said stopping element depending on the rotational position of the detecting plate when the stopper means is operated, said stopper element being engageable with one of said two walls and in so doing causing said reverse rotation of said detecting plate.

4. A slot machine according to claim 3, wherein each of said grooves has an inner radial portion leading from said outer radial portion, said stopping element passing from said outer radial portion to said inner radial portion when said stopper means is operated to stop said drum.

5. A slot machine according to claim 4, wherein said outer radial portion has a circumferential width greater than the circumferential width of said inner radial portion.

6. A slot machine according to claim 1, wherein said pattern detecting means comprises detecting holes at equal intervals on said detecting plates.

7. A slot machine according to claim 1, wherein said reader means is an optical reader comprising a light projector and a light receiver.

8. A slot machine according to claim 1, wherein said control means comprises a microcomputer.

9. A slot machine according to claim 1, wherein said pattern confirming means comprises holes on said detecting plate.

10. A slot machine according to claim 1, wherein detection elements for said pattern confirming means are radially spaced from said detection elements for said pattern detection means.

11. A slot machine according to claim 10, wherein said pattern detection means comprises a single reference detection element which provides a reference signal for said reader means for each revolution of said detecting plate.

12. A slot machine comprising a plurality of rotary drums having a plurality of frames of patterns, detecting plates on each rotary drum and provided with pattern detecting means whose number corresponds to the number of frames, said detecting plates having grooves, reader means which detect passing of said pattern detecting means during drum rotation, stopping means engaging said grooves in said detecting plates and operable to stop said detecting plates, said stopping means causing reverse rotation of said detecting plate and drum depending on the position of said groove when initially engaged by said stopping means, a control means which counts the output of said reader means and specifies the patterns positioned on a stop line based on the counted value after the drum stops, each of said detecting plates having pattern confirming means which discriminate the pattern positioned on the stop line such that said pattern confirming means detects an increase of said counted value resulting from said reverse rotation of said drum and consequent passing of said pattern detecting means again past said reader means, and correction means providing for correcting said increased counted value in response to said pattern confirming means detecting said increased counted value.

* * * * *